US006869054B1

(12) United States Patent
Pearsall

(10) Patent No.: US 6,869,054 B1
(45) Date of Patent: Mar. 22, 2005

(54) NEWSPAPER HANGER

(76) Inventor: Mack Pearsall, 450 Flat Top Mountain Dr., Fairview, NC (US) 28730

( * ) Notice: Subject to any disclaimer, the term of this patent is extended or adjusted under 35 U.S.C. 154(b) by 0 days.

(21) Appl. No.: 10/463,640

(22) Filed: Jun. 18, 2003

(51) Int. Cl.[7] ..... B42F 13/00
(52) U.S. Cl. ..... 248/339; 232/1 C; 248/174
(58) Field of Search ..... 248/314, 339, 248/317, 459, 174; 232/1 C

(56) References Cited

U.S. PATENT DOCUMENTS 1,656,426 A * 1/1928 Cunningham ..... 232/39
D247,868 S * 5/1978 Britt ..... D7/700
4,201,299 A * 5/1980 Bumgarner et al. ..... 206/554
4,335,864 A * 6/1982 Merlini ..... 248/316.7
4,901,912 A * 2/1990 Pinard ..... 232/1 C
4,928,876 A * 5/1990 Marshall ..... 229/103.1
5,409,161 A * 4/1995 Haskett ..... 232/1 C
5,716,033 A * 2/1998 Gibson ..... 248/95
5,967,405 A * 10/1999 Hanauska ..... 229/103
6,152,362 A * 11/2000 Rosenfeld ..... 229/400
6,360,944 B1 * 3/2002 Gorman ..... 229/400
6,588,134 B1 * 7/2003 Perelli ..... 40/617

* cited by examiner

*Primary Examiner*—Ramon O Ramirez
(74) *Attorney, Agent, or Firm*—Mills Law Firm PLLC

(57) ABSTRACT

A newspaper holder for delivering a newspaper includes a frustoconical sleeve for retaining the upper end of a coiled newspaper and a projecting hook for looping over the doorknob for looping over an exterior doorknob.

11 Claims, 5 Drawing Sheets

NEWSPAPER HANGER

FIELD OF THE INVENTION

The present invention relates to a device for delivering printed publications and in particular to a device for hanging a rolled newspaper from a door handle.

BACKGROUND OF THE INVENTION

Many lodging facilities, such as hotels and motels, provide complimentary copies of newspapers to their guests. The newspapers are delivered in varying ways. Some are merely left outside the door requiring the guest to fully open the door for retrieval. Others are encased in a plastic casing provided with holes for hanging on the outside doorknob. While more convenient for retrieval, the plastic casing is not readily recycled and ultimately ends up in a landfill.

It would accordingly be desirable to newspaper delivery vehicle that provides convenience of retrieval in an environmentally friendly format.

BRIEF SUMMARY OF THE INVENTION

The present invention provides a newspaper hanger formed of recycled paper stock that includes a tapered sleeve for retaining a rolled newspaper and a hook for looping the hanger and paper over the outer doorknob. The sleeve is formed from die cut planar stock in the form of an elongate band. The distal ends are interconnect to form a frustoconical sleeve having an open top and a slightly smaller open bottom. The newspaper may be conveniently mounted in the sleeve by rolling the newspaper into a coiled configuration smaller than the open bottom. The coiled newspaper is inserted into the sleeve with the top below the hook. Upon release, the upper end of the newspaper uncoils into conformity with the sleeve to secure the newspaper. The hanger hook may be conveniently hung on the exterior doorknob for retrieval. After removal the hanger may be compacted for recyclable disposal with other paper products.

Accordingly, it is an object of the invention to provide a newspaper holder made of recyclable materials.

Another object of the invention is to provide a recyclable newspaper holder formed from planar stock and assembled to handle newspapers of varying sizes.

A further object of the invention is to provide a newspaper holder that may be hung on an exterior doorknob and compactly holds a rolled newspaper.

DESCRIPTION OF THE DRAWINGS

The above and other features and advantages of the present invention will become apparent upon reading the following detailed description taken in conjunction with the accompanying drawings in which.

DETAILED DESCRIPTION OF THE PREFERRED EMBODIMENT

Figure 1:
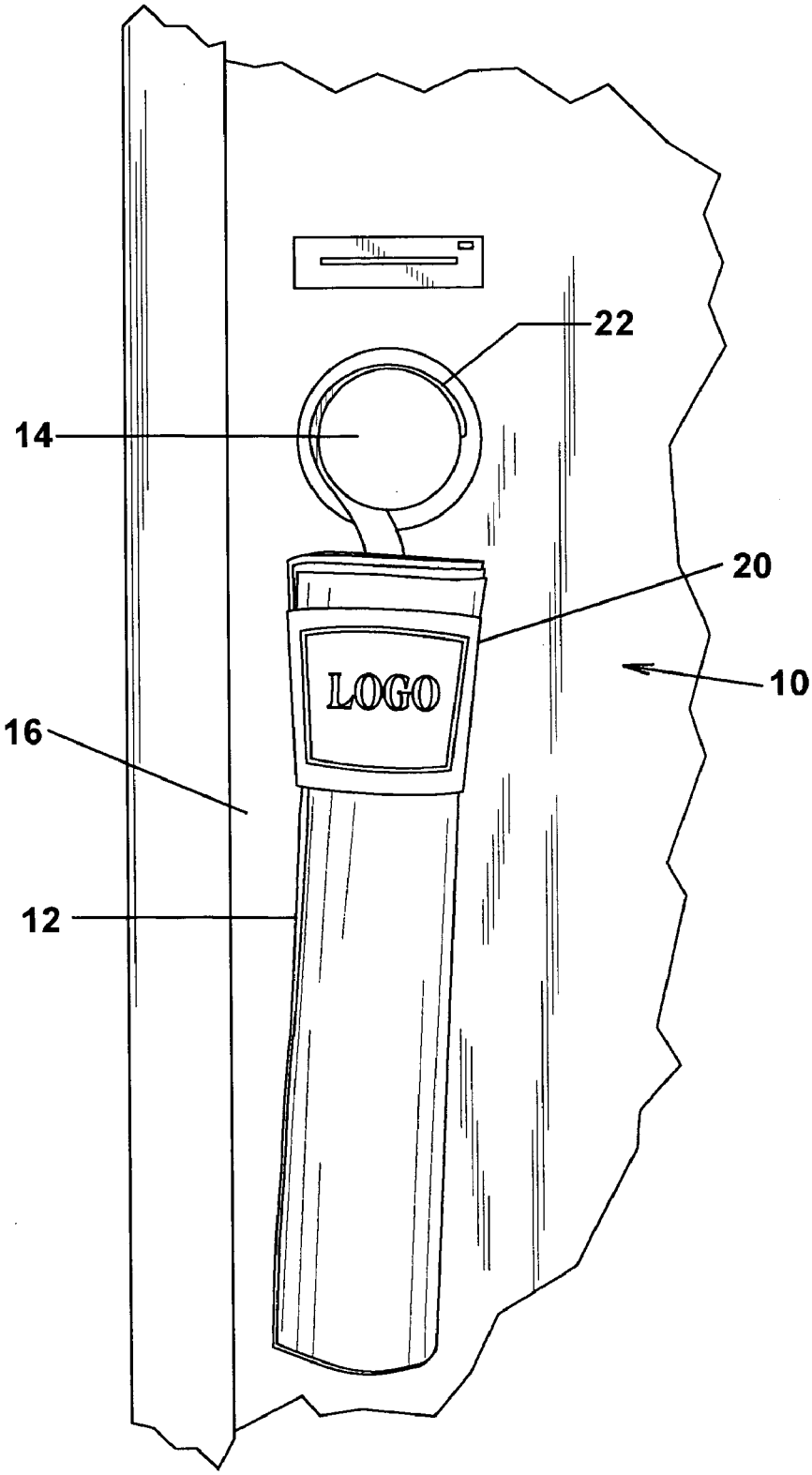
FIG. 1 is a perspective elevational view of a newspaper hanger carrying a rolled newspaper and hung on a doorknob in accordance with a preferred embodiment of the invention.

Referring to the drawings for the purpose of illustrating a preferred embodiment of the invention and not for limiting same, FIG. 1 shows a newspaper hanger 10 carrying a rolled newspaper 12 and hanging from the doorknob 14 of a door 16. In one preferred usage, the newspaper hanger 10 carries a complimentary copy of a news publication oftentimes provided at lodgings such as hotels and motels.

Figure 2:
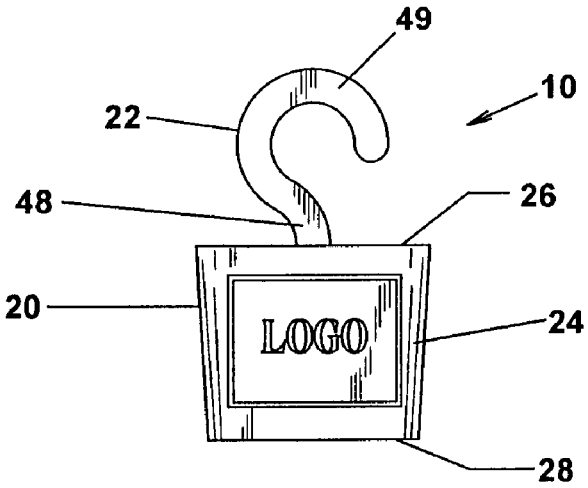
FIG. 2 is a front view of the newspaper hanger of FIG. 1.
Figure 3:
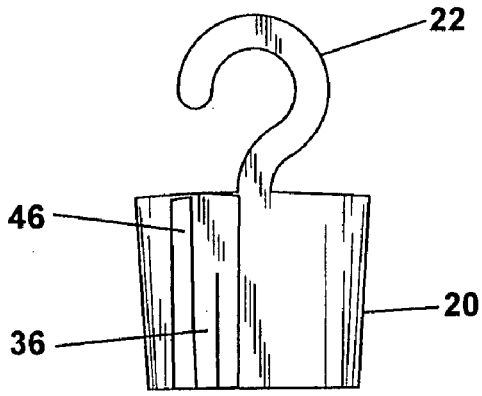
FIG. 3 is a rear view of the newspaper hanger of FIG. 1.
Figure 4:
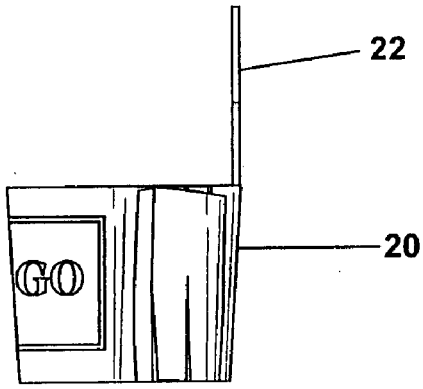
FIG. 4 is a side view of the newspaper hanger of FIG. 1.

As additionally shown in FIGS. 2 through 4, the hanger 10 includes a selectively expandable frustoconical sleeve 20 terminating with an upwardly extending hook 22 that is placed over the stem of the doorknob. The hanger 10, as explained in greater detail below, is formed from flat paper stock preferably having recycled fiber content.

Figure 5:
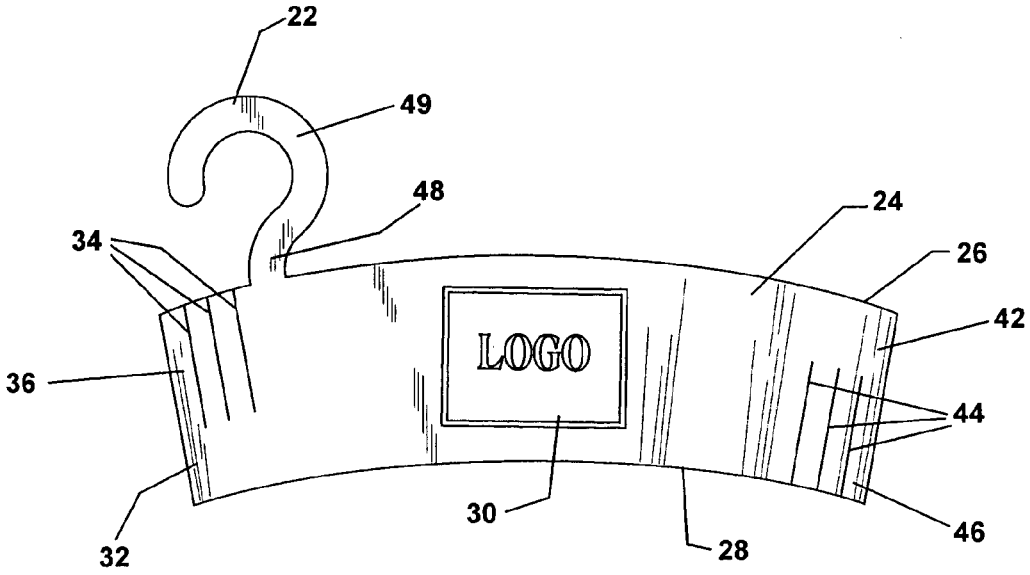
FIG. 5 is a plan view of the sleeve of the newspaper hanger prior to assembly.

The sleeve 20 is formed from a single length of stock as shown in FIG. 5. The sleeve 20 in assembly comprises an elongate band 24 having a generally circular upper rim 26 and a generally circular lower rim 28 of lesser diameter, with the band circumscribing, in assembly, a shallow downwardly converging conical angle of about 50 to 15°. The axial width of the band 24 is around 2 to 4 inches with an upper diameter varying between about 2½ to 4 inches. The edges defining the rims 26, 28 may be straight, curvilinear or decoratively sculpted depending on aesthetic preferences. The front of the sleeve 20 may be imprinted with indicia 30 denoting goods, services or other types of written information.

One distal end 32 of the band 24 is provided with transversely downwardly extending, longitudinally circumferentially spaced slits 34 extending from the upper rim 26 and defining tabs 36. The other distal end 42 of the band 24 is provided with transversely upwardly extending, longitudinally circumferentially spaced slits 44 extending from the lower rim 28 and defining tabs 46. In assembly, as shown in FIG. 3, the ends are overlapped and the tabs 36, 46 interlocked at the slits 34, 44 to establish the frustoconical sleeve 20 of appropriate size for holding the current newspaper. Different tabs and slits may be interlocked for providing varying sized openings selected for a range of publication sizes.

Figure 9:
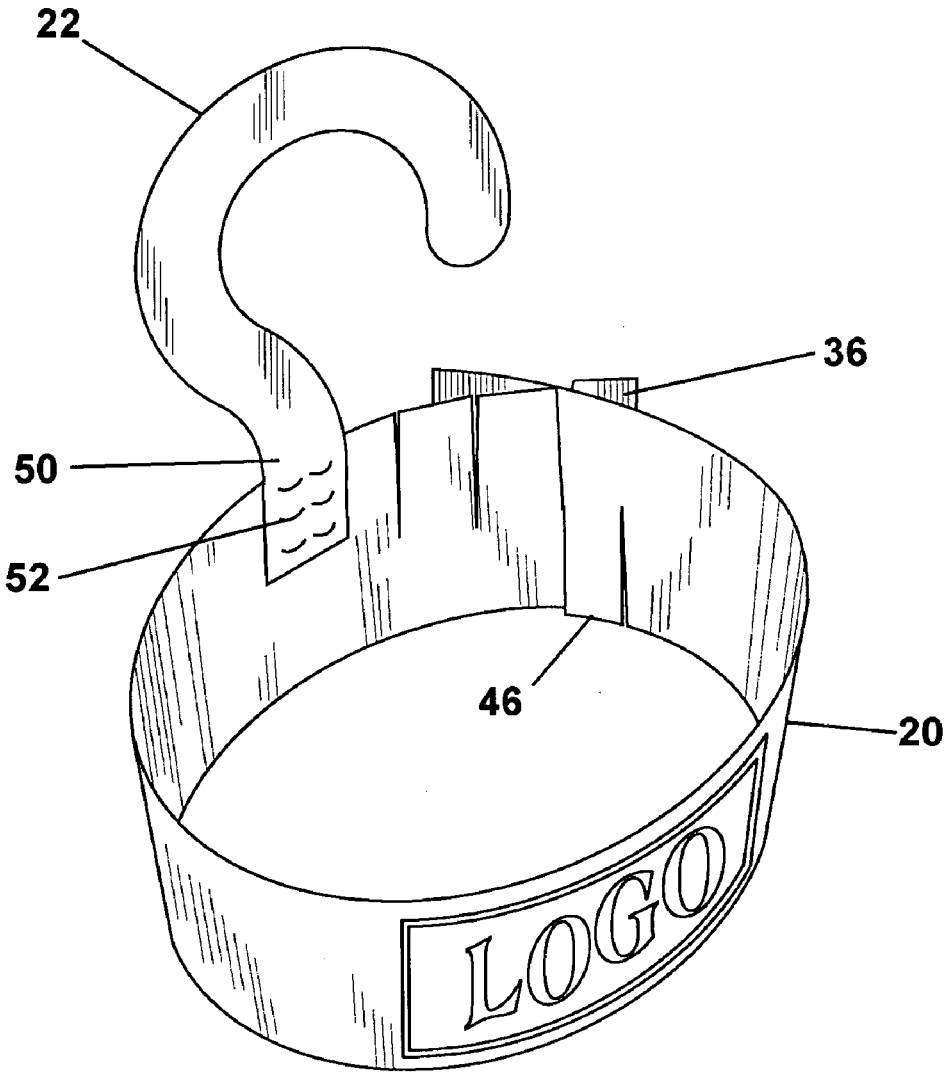
FIG. 9 is a perspective view of another embodiment of the newspaper hanger.

The hook 22 may be integral with the band 24 or assembled as a separate piece as illustrated in FIG. 9 and described below. There, the hook 22 includes a vertical stem 48 attached integrally with the band 24 terminating with an inverted semicircular loop 49. The inner edge of the loop has a radius substantially greater than the stem of the doorknob thereby facilitating simple insertion thereover for supporting the hanger and associated newspaper.

Referring to FIG. 9, the hook 22 may be formed as a separate item with an elongated stem 50 that is attached to the sleeve 20 by suitable means such as the illustrated staples 52 or other suitable mechanical or adhesive attachment. It will also be appreciated that the distal ends may be overlapped and joined, mechanically or adhesively, for a desired size configuration. Further, the assembly may be folded to a flat configuration for compacting shipping and storage.

Figure 6:
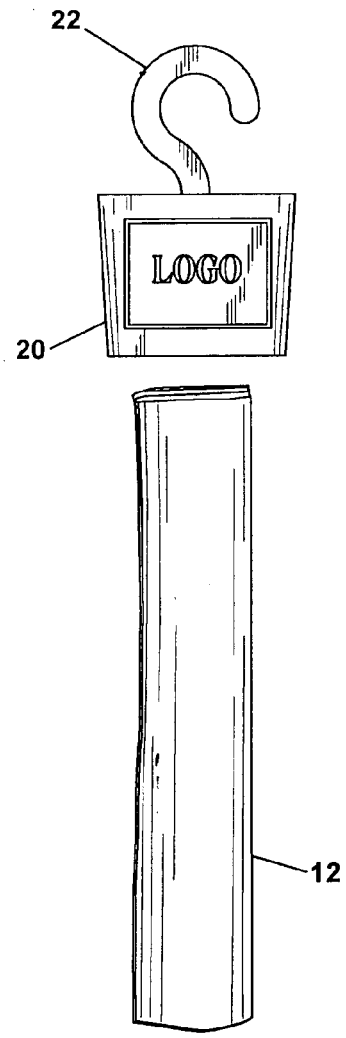
FIG. 6 is a front view illustrating a rolled newspaper prior to insertion into the sleeve.
Figure 7:
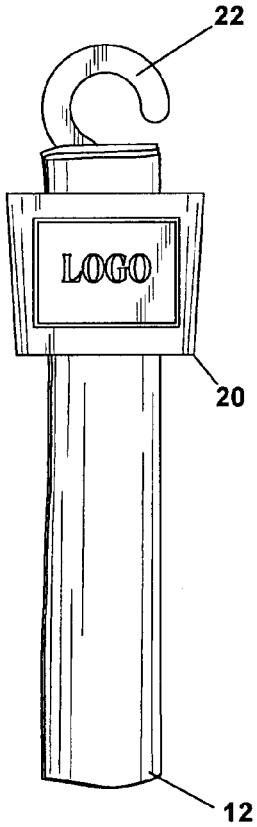
FIG. 7 is a front view illustrating the rolled newspaper after initial insertion into the sleeve.
Figure 8:
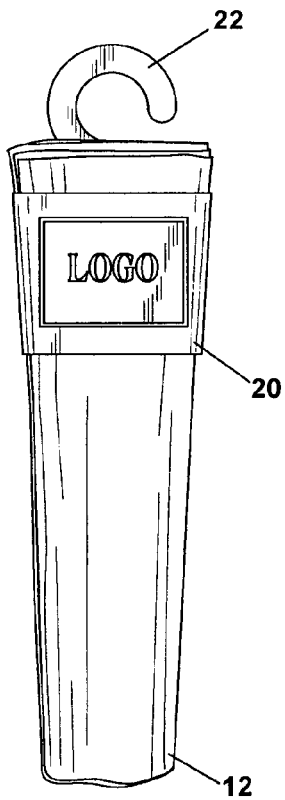
FIG. 8 is a front view illustrating the roller newspaper in storage position in the sleeve.

Referring to FIGS. 6 through 8, the sleeve is initially adjusted to present an opening for the size newspaper 12 being delivered through interlocking at the slits 36, 46. Thereafter, the newspaper 12 is rolled to a diameter smaller than the bottom opening in the sleeve 20 as shown in FIG. 6. The rolled newspaper 50 is inserted upwardly or downwardly into the sleeve 20 with the upper end thereof spaced slightly above the upper rim but not interfering with the opening on the hook 22 as shown in FIG. 7. When released, the upper end of the newspaper uncoils and conforms with the inner surface of the band, tightly holding the newspaper in place. The hanger is then placed on the doorknob at delivery site for convenient retrieval by the guest.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A newspaper holder for holding a rolled newspaper for delivery on an exterior doorknob, comprising: an elongated band formed from planar stock and having distal ends connected to form a frustoconical sleeve with a downward taper and open upper and lower ends wherein said band circumscribes a shallow downwardly converging conical angle of about 5° to 15°, and has an inner surface for engaging a center portion of the rolled newspaper with the upper portion of the newspaper extending above said upper end and a lower portion of the newspaper extending below said lower end, wherein one distal end of said sleeve is provided with upwardly opening slits defining upwardly extending tabs and the other distal end of said sleeve is provided with downwardly opening slits defining downwardly extending tabs, said distal ends being overlapped and interlocked at said slits to provide an adjustable sleeve configuration for holding newspaper of varying sizes; and a hook extending upwardly from said band and configured for hanging over the doorknob.

2. The newspaper holder as recited in claim 1 wherein said hook is integral with said band.

3. The newspaper holder as recited in claim 2 wherein said hook includes a downwardly extending stem fixed to said band.

4. The newspaper holder as recited in claim 1 wherein said hook is mechanically fastened to an inner surface of said sleeve.

5. The newspaper holder as recited in claim 4 wherein said sleeve and said hook are formed of planar stock having recycled fiber content.

6. A method of delivering a newspaper at a exterior door knob of a door, comprising the steps of: providing a downwardly tapering frustoconical sleeve having an open top end and an open bottom end; rolling the newspaper into a coiled configuration having a cross sectional size smaller than said bottom end; inserting said newspaper while retaining said coiled configuration into said sleeve with the upper end projecting slightly above said sleeve; releasing said coiled configuration to permit uncoiling of said newspaper into conformity with said sleeve; providing a hook at the upper end of said sleeve configured for suspension from said doorknob; and positioning said hook on said doorknob to suspend the sleeve and newspaper therefrom.

7. The method as recited in claim 6 including the step of forming said sleeve from a strip of planar material and providing adjusting means at the ends of said strip for changing the size of the sleeve for accepting coiled configurations of varying sizes.

8. The method as recited in claim 7 including forming said sleeve from a planar material having substantial recycled fiber content.

9. The method as recited in claim 8 including the step of providing indicia on the outer surface of said sleeve referenced to designated goods and/or services.

10. The method as recited in claim 7 wherein said sleeve circumscribes a shallow downwardly converging conical angle of about 50° to 15°.

11. A newspaper holder for holding on an exterior doorknob, comprising: an elongated band formed from planar stock and having distal ends connected to form a frustoconical sleeve with a downward taper and having an open top end and an open bottom end; a rolled newspaper inserted into said sleeve with a lower portion extending below said lower end and a upper portion extending above said top end, said newspaper unrolling into conformity with an inner surface of the sleeve to maintain the position of the newspaper thereagainst; and a hook extending upwardly from said band and configured for hanging over the doorknob.

* * * * *